United States Patent [19]

Gandy

[11] Patent Number: 5,021,019

[45] Date of Patent: Jun. 4, 1991

[54] NOVELTY SQUIRTING STRAW

[76] Inventor: Kenneth A. Gandy, 11706 E. 75th St., Indianapolis, Ind. 46236

[21] Appl. No.: 467,773

[22] Filed: Jan. 19, 1990

[51] Int. Cl.[5] ..... A63J 23/00

[52] U.S. Cl. ..... 272/27 B; 446/180; 446/202; 239/33

[58] Field of Search ..... 446/202, 176, 180, 475, 446/483; 272/27 N, 27 B, 27 R, 8 N, 8 R; 239/33

[56] References Cited

U.S. PATENT DOCUMENTS 1,813,285 7/1931 Galetschky ..... 239/33

3,879,885 4/1975 Fabricant ..... 446/71

4,658,990 4/1987 Ramage ..... 239/33 X

OTHER PUBLICATIONS

"Show Time for Young Scientists", George Barr, McGraw-Hill Book Co., pp. 138-139, 201, 1965.

*Primary Examiner*—Mickey Yu

[57] ABSTRACT

A squirting straw device for playing a practical joke on a drinker or another nearby is described. The straw is constructed so as to direct pressurized liquid to strike the supposed drinker or another nearby in response to suction being applied at an opening of the straw.

18 Claims, 6 Drawing Sheets

NOVELTY SQUIRTING STRAW

BACKGROUND OF THE INVENTION

The present invention relates generally to the field of novelty devices. More particularly, this invention relates to a novelty squirting straw which, to the surprise and perhaps dismay of an unwary supposed drinker, instead of affording a comforting sip, directs pressurized liquid to squirt the supposed drinker in the face or otherwise. In addition, to those aware of their function, devices of the invention provide stimulating ways to drink liquid.

By way of background, we humans have been caught up with playing practical jokes on one another for centuries. For example, whether it be tying one anothers shoelaces together or the use of the old standby squirting flower, practical jokes have provided useful entertainment for some time.

Despite the existence of these and other prior novelty devices and practical jokes, there exists an ever constant demand and need for improved and varying practical jokes to sate the sense of humor of we human beings, especially in a world which some would say grows more technical and complicated, and less humorous, by the day.

The applicant has now succeeded in addressing this need and demand and accordingly provides the novelty squirting straw device as described herein.

SUMMARY OF THE INVENTION

By way of example, one embodiment of the present invention might include a novelty squirting straw device for playing a practical joke on a supposed drinker or on another nearby. Such a squirting straw comprises a cylindrical member having at least a first opening. This cylindrical member in some preferred embodiments might be transparent and/or include colorings on its outer surface in order to help make the device appear as an ordinary drinking straw. This squirting straw also comprises means for directing pressurized liquid at the drinker or another nearby in response to suction applied at the first opening of the cylindrical member.

One object of the present invention is to provide a squirting straw device for playing a practical joke on a drinker nearby.

Another object of the present invention is to provide a practical joke squirting straw device which is relatively simple in its design.

Another object of the present invention is to provide a method for playing a practical joke which would include the use of a squirting straw as herein described.

Other objects and advantages of the present invention will become apparent upon reading description which follows.

DESCRIPTION OF THE PREFERRED EMBODIMENT

Figure 1:
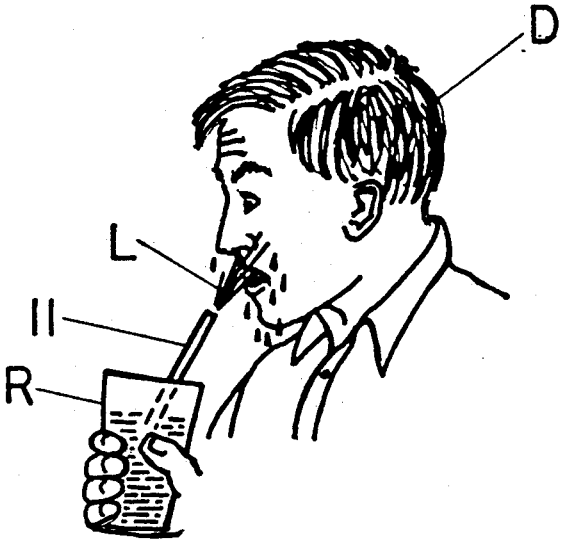
FIG. 1 is a perspective view of a squirting straw device directing pressurized liquid at a supposed drinker.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

In accordance with the discussion above, one embodiment of the present invention relates to a squirting straw device for playing a practical joke on a drinker or on another nearby which includes a cylindrical member having at least a first opening, and means for directing pressurized liquid at said drinker or another nearby in response to suction applied at said first opening. Preliminarily in this regard, the phrase "in response to suction applied at said first opening" as used herein is meant to encompass situations where the liquid is directed as indicated either during or after the suction is applied, as will be evidenced and exemplified in the several specific embodiments described herein.

Figure 2:
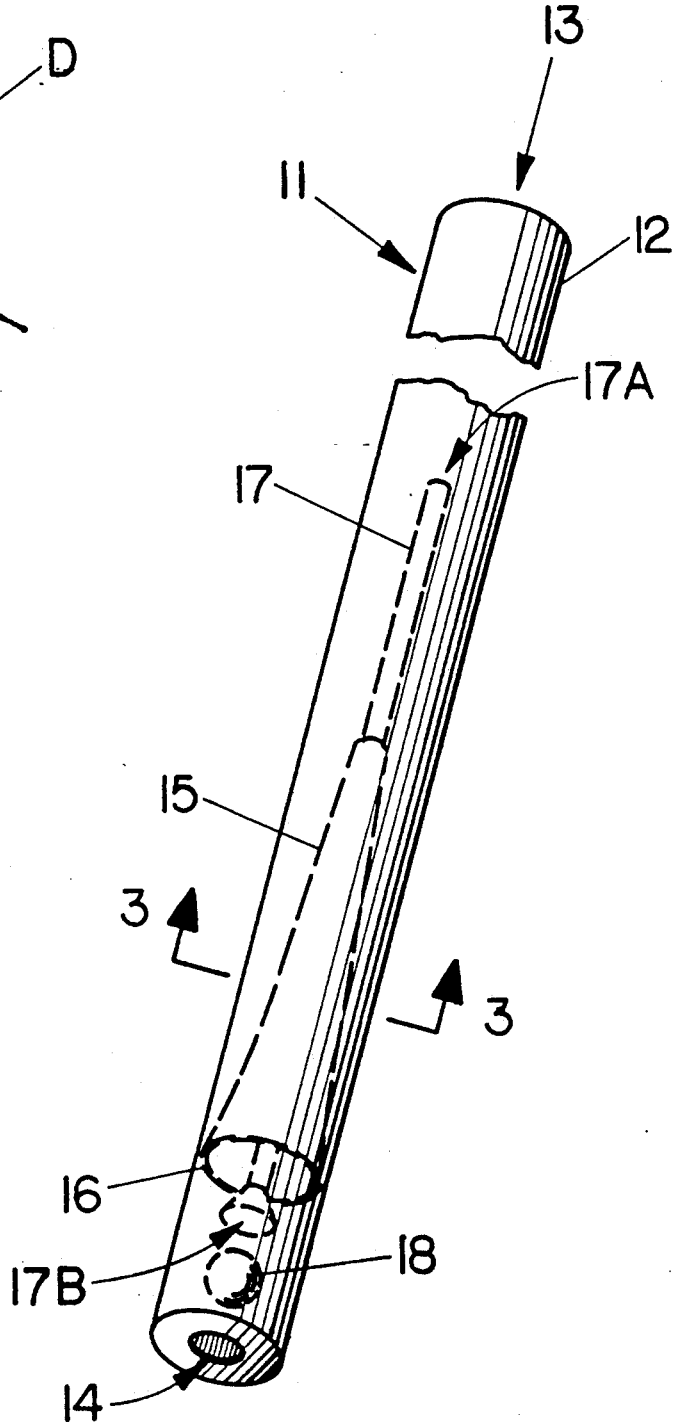
FIG. 2 is a perspective view of a squirting straw device according to the invention.

Referring now to FIG. 1, shown is a perspective view of a squirting straw device 11 according to the invention directing pressurized liquid "L" at a supposed drinker "D". With reference also now to FIG. 2, the squirting straw device 11 according to the present invention includes a cylindrical member 12 which has a first open end 13 and a second open end 14. The cylindrical member 12 is preferably constructed of a sturdy plastic, and is preferably non-transparent. In addition, the cylindrical member 12 is sized and may have a colored pattern on its exterior surface in order to help make it appear as an ordinary drinking straw.

Figure 3:
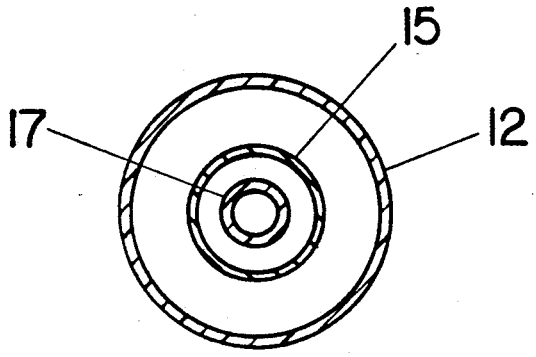
FIG. 3 is a cross-sectional view of the squirting straw device of FIG. 2 taken along line 3—3 and viewed in the direction of the arrows.
Figure 5:
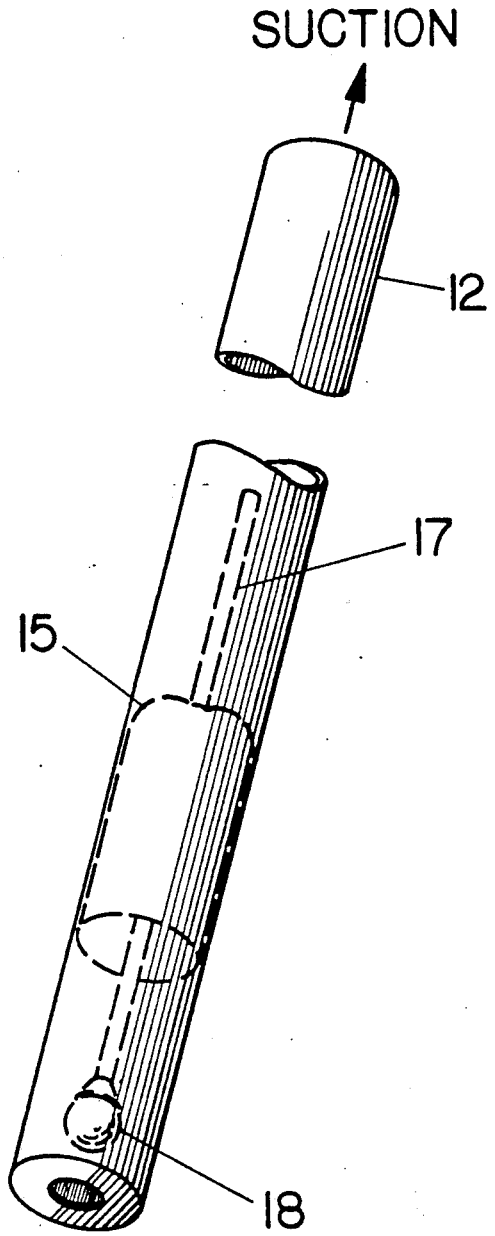
FIG. 5 is a view depicting how a squirting straw device according to the invention might appear as suction is applied.
Figure 4:
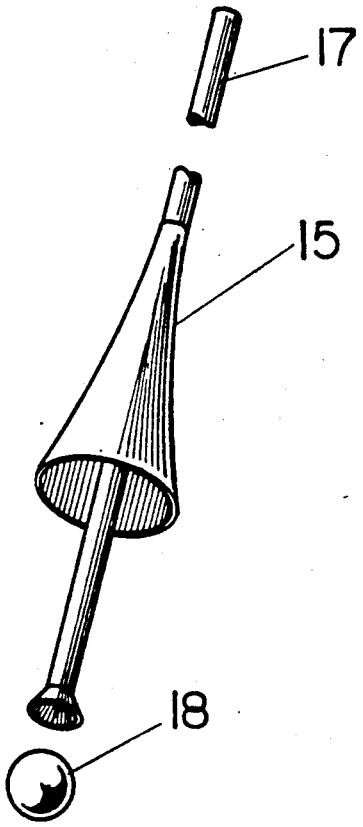
FIG. 4 is a view of inner components of the squirting straw device of FIG. 2.

The squirting straw device 11 of the present invention will now further be described with continuing reference to FIG. 2, and also taken together with FIGS. 3 and 4. FIG. 3 is a cross-sectional view of the squirting straw device of FIG. 2 taken along line 3—3 and viewed in the direction of the arrows. FIG. 4 is a view of inner components of the squirting straw device 11 of FIG. 2 to show them more clearly.

Positioned within the cylindrical member 12 is a resilient membrane 15. The membrane 15 is sufficiently resilient and is of a size such that it can expand within the cylindrical member 12 in response to suction applied to the first open end 13 of the cylindrical member 12 by a supposed drinker. Preferably, the membrane 15 is constructed of rubber or another suitable synthetic resilient material similar to the material used to construct commonly available rubber-type balloons. The periphery of the membrane 15 is sealingly attached about the inner surface of the cylindrical member 12, as at 16, to provide a fluid-tight seal between the periphery of the membrane and the inner surface of the cylindrical member 12.

A smaller generally cylindrical tube 17 is also provided within the cylindrical member 12. The smaller tube 17 extends through the membrane 15 leaving the first open end 17*a* and second open end 17*b* of the smaller tube 17 positioned on opposite sides of the membrane 15 with the open end 17*a* occurring toward the first open end 13 of the cylindrical member 12 and the open end 17*b* occurring toward the second open end 14 of the cylindrical member 12. At the point where the smaller tube 17 extends through the membrane 15, the membrane is sealingly attached about the outer periphery of the smaller tube 17 in order to provide a fluid-tight seal therebetween.

Also provided is a generally spherical ball 18. The ball 18 is provided in a space within the cylindrical member 12 between the resilient membrane 15 and the second open end 14 of the cylindrical member. The ball 18 has a diameter which is larger than the diameter of the second open end 14 of the cylindrical member 12 so that it will not pass through the open end 14 but rather can temporarily lodge within and seal or substantially seal the open end 14. The diameter of the ball 18 is also larger than the second opening 17*b* of the smaller tube 17 and thus the ball 18 can also temporarily lodge in the opening 17*b* to effectively seal the opening 17*b*. Although it may be constructed of other suitable materials, the ball 18 is preferably constructed of a suitable rubber or plastic and preferably has a density at least substantially equal to or greater than that of water, or of whatever other fluid may be used with the device 11.

Referring now to FIGS. 1–4 together, the operation of the squirting straw device 11 will now be described. As a supposed drinker "D" applies suction to the first open end 14 of the cylindrical member 12, a vacuum is transmitted through the smaller cylindrical tube 12, water begins flowing from the receptacle of liquid ("R" of FIG. 1), and the ball 18 is urged up toward the second open end 17*b* of the smaller tube 17. The ball 18 lodges within the open end 17*b* of the smaller tube 17 and effectively seals it so that little if any water is able to pass up the smaller tube 17. Fluid communication between the first open end 13 and second open end 14 of the cylindrical member 12 is thus completely or at least substantially cut off since fluid-tight seals are provided between the membrane 15 and inner surface of the cylindrical member 12 and between the membrane 15 and the outer periphery of the smaller tube 17. Consequently, as further suction is applied by the supposed drinker "D", the membrane 15 expands and fluid continues to flow into the cylindrical member 12 through the open end 14 and is stored in the cylindrical member 12 in a pressurized manner (see particularly FIG. 4 for a depiction of a device 11 in this general condition).

When the drinker "D" realizes that the squirting straw device 11 is not performing in accordance with expectations (i.e. the supposed drinker cannot normally drink from it) and subsequently discontinues the suction at the first open end 13 of the cylindrical member 12, the vacuum within the smaller tube 17 dissipates and the ball 18 dislodges from the opening 17*b*. Additionally, the resilient membrane 15 snaps back toward its original position thus forcing the stored water downward. The snap back of the membrane 15 and the downward flow of liquid urges the ball 18 quickly to lodge within and seal or substantially seal the second open end 14 of the cylindrical member 12. With the second open end 14 of the cylindrical member 12 thus sealed, and with the membrane 15 continuing to force downwardly, the liquid is forcefully propelled upwardly through the smaller tube 17 and exits the first opening 17*a* of the tube 17 as a stream of liquid ("L" in FIG. 1). This stream of fluid "L" is projected out of the first open end 13 of the cylindrical member 12 and strikes the surprised drinker "D". In this regard, it is also contemplated that the tube 17 could be modified so as to sealingly exit the side of the cylindrical member 12 at some point and thus propel a stream of water still at the drinker or alternatively at someone nearby.

Figure 6:
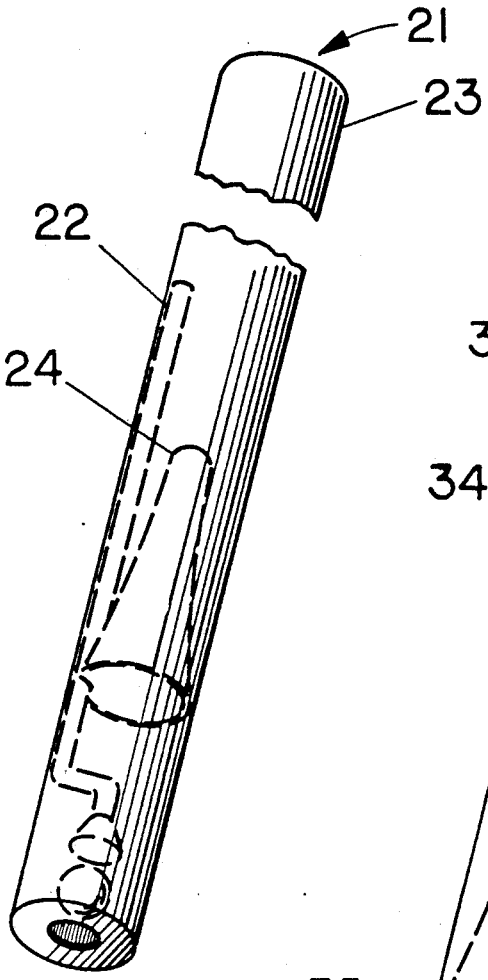
FIG. 6 is a perspective view of a modified squirting straw device according to the present invention.

With reference now to FIGS. 6, 7, 8 and 11, shown are modified squirting straw devices according to the present invention which, unless otherwise shown or described, include similar components and function similarly to the squirting straw device 11 which is describe above. For instance, the squirting straw device 21 pictured in FIG. 6 is similar to the squirting straw device 11 previously described. However, in this modified device 21, a smaller tube 22 is attached to or otherwise built into the inner wall of the larger cylindrical member 23. In this fashion, the smaller tube 22 does not pass through the membrane 24. Rather, the periphery of the membrane 24 is sealed about the inner surface of the cylindrical member 23 including being sealed in the area where the smaller tube 22 forms part of or is otherwise attached to the inner wall of the cylindrical member 23.

Figure 7:
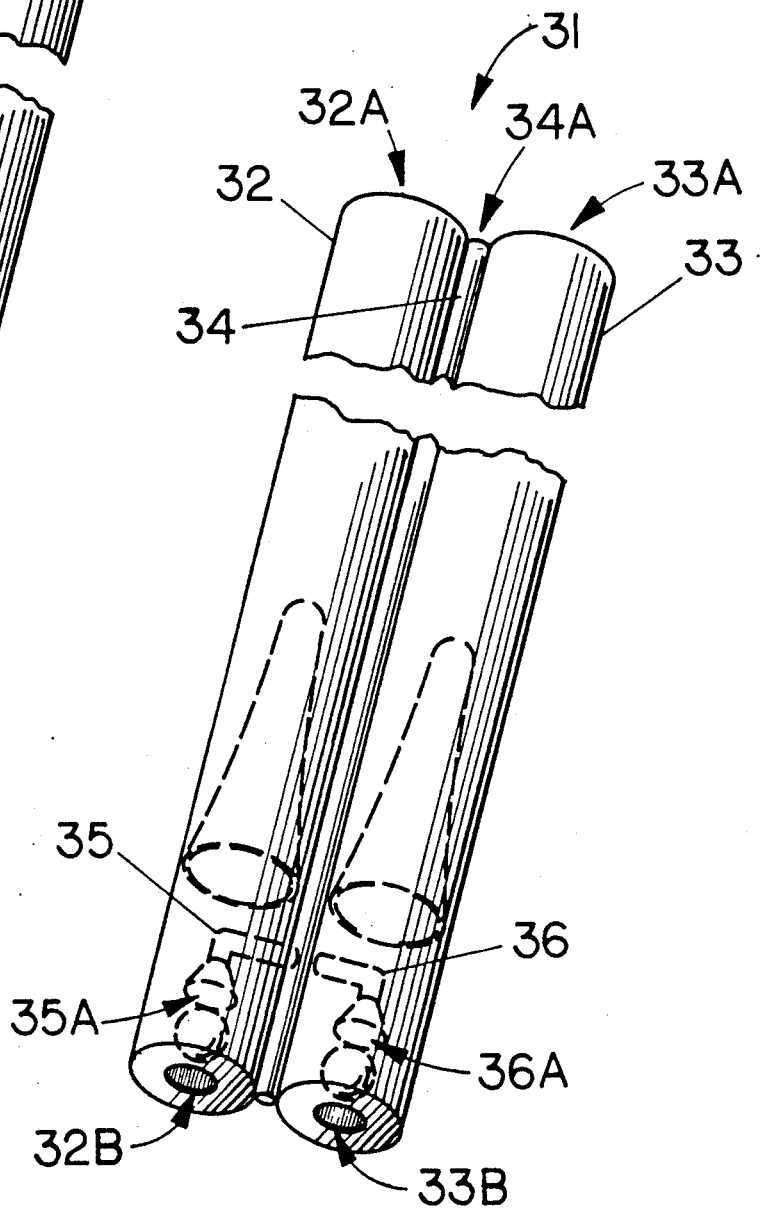
FIG. 7 is a perspective view of a modified "double barrel" squirting straw device according to the invention.

Referring now to FIG. 7, shown is a modified "double barrel" squirting straw device 31 according to the present invention. In this embodiment, two larger cylindrical members 32 and 33 are provided. Situated between and connected to them is smaller cylindrical tube 34. As the illustrated design depicts, the basic operating principals and components of the formerly described devices 11 and 21 are generally incorporated into the "double barrel" device 31. Preferably, each cylindrical member 32 and 33 is provided with its own membrane and ball. Additionally, fluid communication between the cylindrical members 32 and 33 and the smaller tube 34 is provided by connecting members 35 and 36. These connecting members 35 and 36 also have openings 35*a* and 36*a*. In this device, when a supposed drinker applies suction to the openings 32*a* and 33*a* of the cylindrical members 32 and 33 and to the opening 34*a* of the smaller tube 34, a vacuum is created in the cylindrical members 32 and 33 and in the smaller tube 34. The vacuum in the smaller tube 34 is transmitted through the connecting members 35 and 36 to the openings 35*a* and 36*a*, and the balls are urged into and seal the openings 35*a* and 36*a*. The membranes in the cylindrical members 32 and 33 expand as further suction is applied to openings 32*a* and 33*a*, water flows into the cylindrical members through openings 32*b* and 33*b* and is stored in a pressurized manner in each cylindrical member 32 and 33. Again, when the applied suction is discontinued, the balls become dislodged from the openings 35*a* and 36*a* of the connecting members 35 and 36 and are urged downwardly and lodge in and seal the openings 32*b* and 33*b* of cylindrical members 32 and 33. Liquid is then forced by the membranes through the connecting members 35 and 36 and upwardly through smaller tube 34, exiting smaller tube 34 in a pressurized stream which strikes the supposed drinker.

Figure 8:
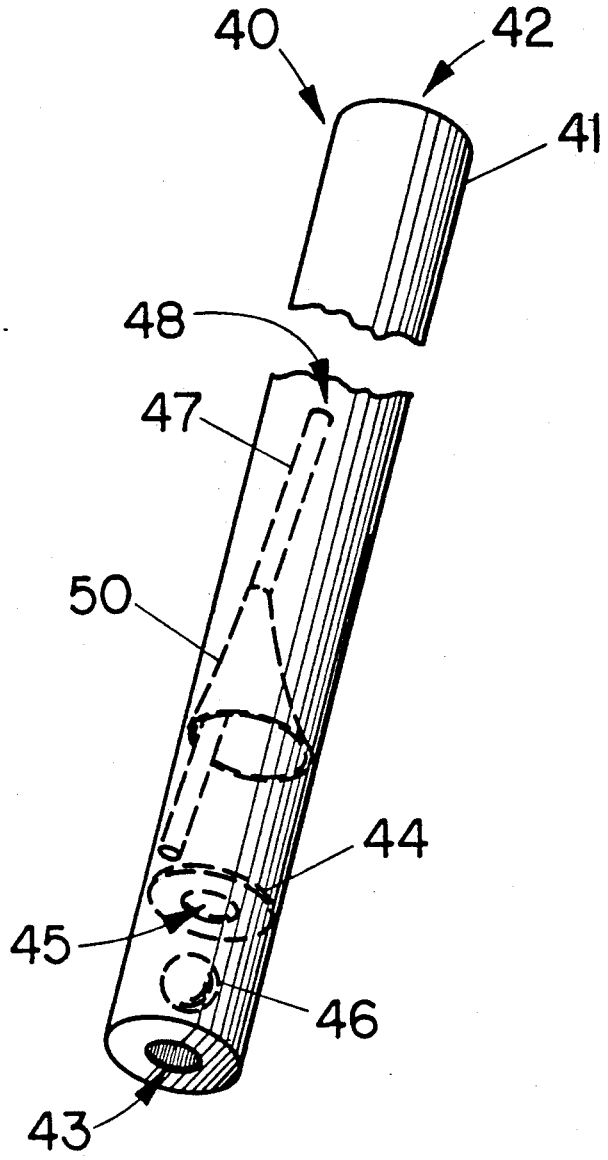
FIG. 8 is a perspective view of squirting straw device according to the invention which can be pre-loaded with pressurized liquid.
Figure 9:
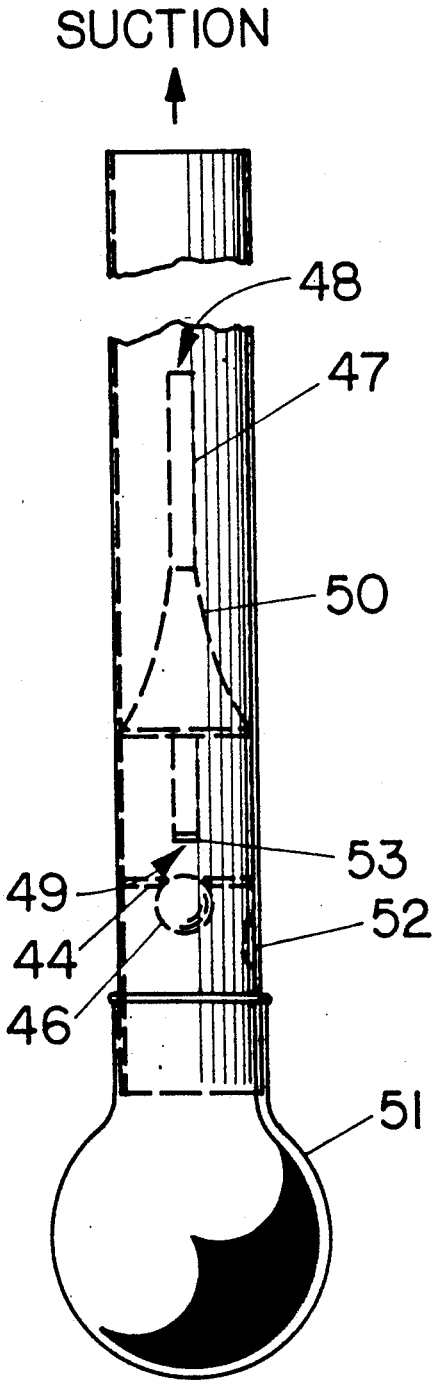
FIG. 9 is a side view of the device of FIG. 8 as it might appear while suction is being applied.
Figure 10:
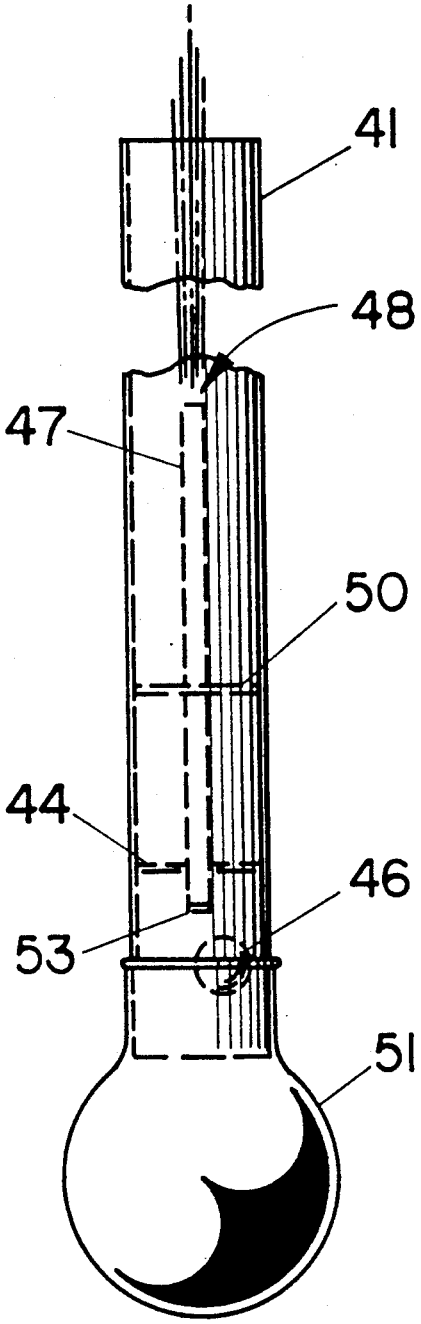
FIG. 10 is a side view of the device of FIG. 8 as it might appear imediately after suction has been applied and then released.

Referring now to FIGS. 8–10, shown is another squirting straw device 40 according to the invention which, instead of relying on the suction of the supposed drinker to supply pressurized liquid, can be pre-loaded with pressurized liquid, which is in turn triggered to squirt the supposed drinker when the supposed drinker applies suction. As with the other embodiments described herein, the device 40 includes a cylindrical member 41 which has open ends 42 and 43. The device 40 also includes an inner wall 44 which is sealed about the inner surface of the cylindrical member 41 and also has an opening 45. A ball 46 resides between the open end 43 and the wall 44. The ball 46, the open end 43, and the opening 45 are relatively sized so that the ball 46 cannot pass through the open end 43 or the opening 45 but rather can lodge therein and seal or substantially seal the same. The device 40 also includes a smaller cylindrical tube 47 having its own openings 48 and 49. The tube 47 is sealingly mounted through a resilient membrane 50 sealed about the inner periphery of the cylindrical member 41 similar to the other embodiments described above. In operation, the smaller tube 47 is manually forced upwardly and to the side as pictured in FIG. 8 so that it lodges and rests upon the upper surface of the inner wall 44. In this condition, the tube 47 is biased downwardly due to the upward stretching of the resilient membrane 50 as pictured in FIG. 8. The tube 47 can be so positioned by accessing through the open end 43 and opening 44, or through the open end 42, possibly using a small instrument to assist in the placement. Alternatively, it is contemplated that some other provision could be provided in the structure of the device for "setting the trigger."

A resilient rubber-type balloon or the like 51 filled with pressurized liquid is provided over the open end 43. This in turn fills the intermediate compartment where the ball 46 resides with liquid and forces the ball 46 up into the opening 45 to seal the same. In one embodiment, the device 40 can be provided with a one-way valve into the intermediate compartment, as at 52 in FIG. 9, in order to provide means for filling the balloon 51 with liquid after it is provided at the open end 43. Otherwise, the balloon 51 can be first filled with liquid and then placed upon the open end 43. With the filled balloon so in place, the device 40 is set and ready for use. In use, when suction is applied to the open end 42, the membrane 50 stretches further upward thus unlodging the bottom end of the tube 47 from the upper surface of the inner wall 44. The tube 47 is positioned through the membrane 50 such that when it is so unlodged, the tube positions itself over the opening 45 while suction is being applied, as pictured in FIG. 9. When suction is thereafter released, the tube 47 is forced downwardly through the opening 45 (as pictured in FIG. 10) thus dislodging the ball 46 from the opening 45 and allowing the flow of the pressurized liquid up through the tube 47. The liquid thus exits the upper opening 48 of the tube in a pressurized stream which strikes the supposed drinker. In this regard, the tube 47 can in a preferred embodiment be provided at its lower end with a wire or plastic screening structure 53 which allows the liquid to pass but helps prevent the ball 46 from lodging in the lower opening 49 of the tube 47 during the squirting phase.

Figure 11:
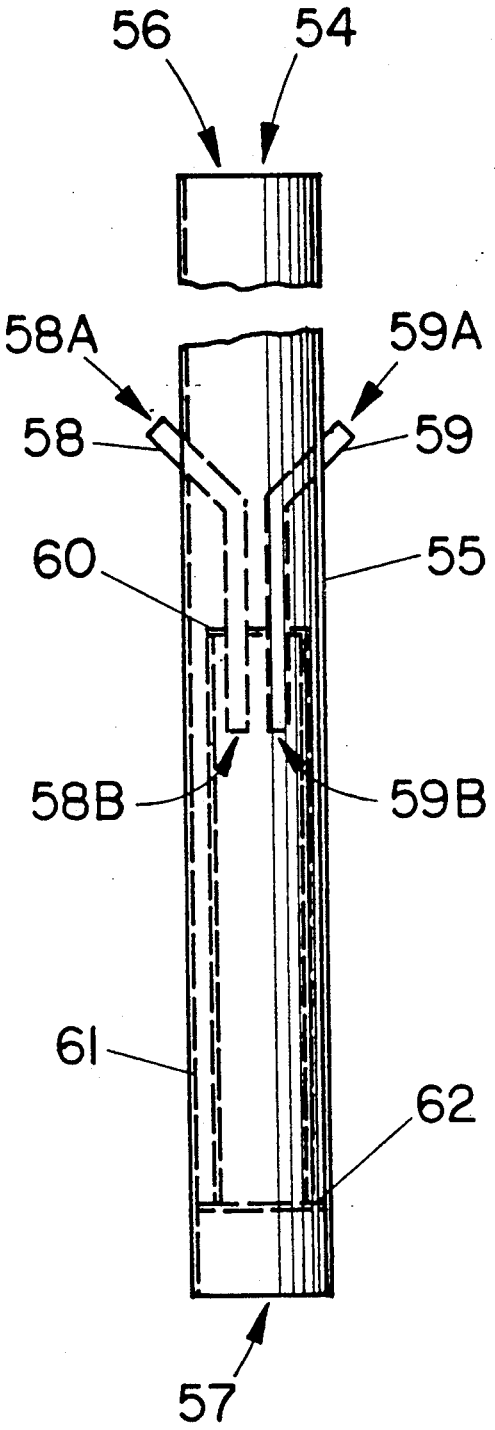
FIG. 11 is a side view of another squirting straw device in accordance with the invention.

Referring now to FIG. 11, shown is another squirting straw device 54 in accordance with the invention. This device 54 also includes a cylindrical member 55 having open ends 56 and 57. The device also includes at least one, and in the pictured embodiment two smaller tubes 58 and 59 having respective open ends 58*a* and 58*b* and 59*a* and 59*b*. The tubes exit the side of the cylindrical member 55. A fluid tight seal is provided around the outside of the tubes 58 and 59 where they exit the cylindrical member 55. The the portions of tubes 58 and 59 on the inside of the cylindrical member 55 extend down through an inner wall 60 (also provided with fluid tight seals around their outsides where they extend through the wall 60). A flexible and optionally resilient cylindrical membrane 61 has its circular periphery on one end sealed fluid tight to the bottom surface of the inner wall 60. The lower end of the cylindrical membrane 61 has its circular periphery sealed fluid tight to a moveable circular membrane 62 which spans the inner diameter of the cylindrical member 55 but is not attached to the inner walls of the cylindrical member 55. The circular membrane 62 can thus provide a syringe-type action within the device 54.

In operation, the device 54 is loaded with liquid by providing the liquid down through the tubes 58 and 59 to fill the membrane 61. At this stage, the circular membrane 62 resides low in the cylindrical member 55 down nearer to opening 57 and the liquid is stored in a generally unpressurized manner. When thereafter suction is applied to the upper open end 56, a vacuum is formed in the cylindrical member 55 which causes the circular membrane 62 to be forced upwardly. When this happens, the liquid is forced out of the cylindrical membrane 61 up through the tubes 58 and 59 to squirt the supposed drinker or another nearby. In this regard, in order to facilitate a supposed drinker to line the device up so that an exiting tube (such as 58 and/or 59) is pointed at the supposed drinker, a design or a character (i.e. a cartoon-type face) can be affixed to the outside of the device 54 which in normal use of the device 40 a supposed drinker would most likely align in a particular orientation with respect to him or herself (i.e. a character or face which the drinker would most likely have facing or nearer him or herself). In addition, an exiting tube (i.e. 58 and/or 59) can be concealed within and/or made to appear a part of the design, character, face, etc. to make it less noticeable to and/or detectable by the supposed drinker.

Figure 12:
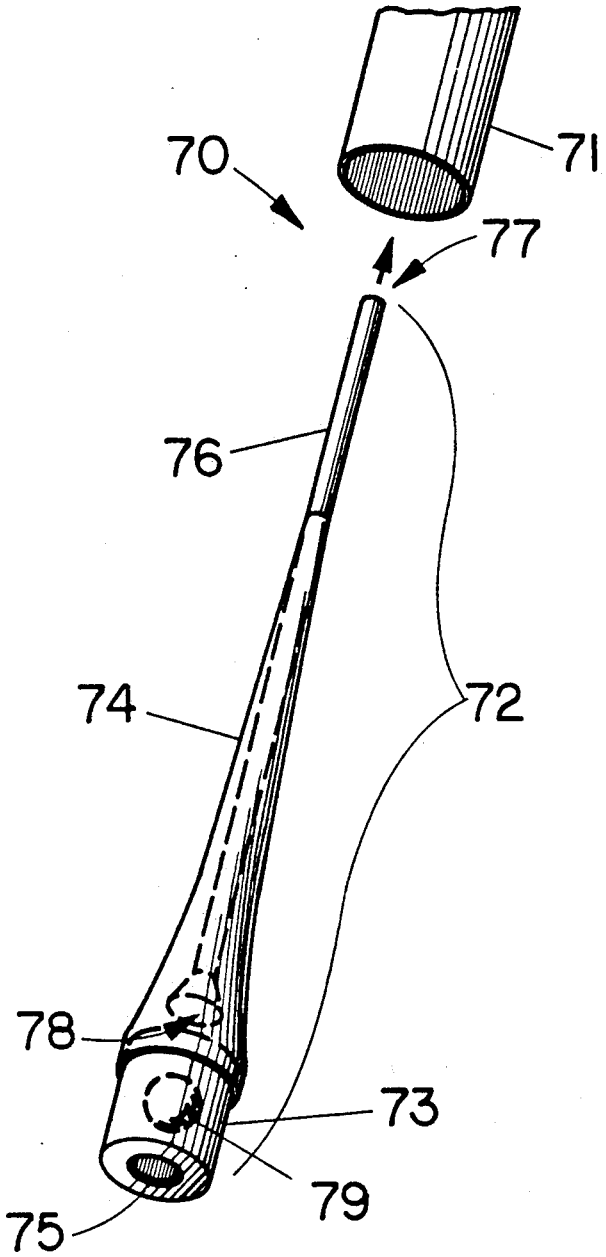
FIG. 12 is a perspective view of another squirting straw device in accordance with the invention with a portion cut away for illustrative purposes.
Figure 13:
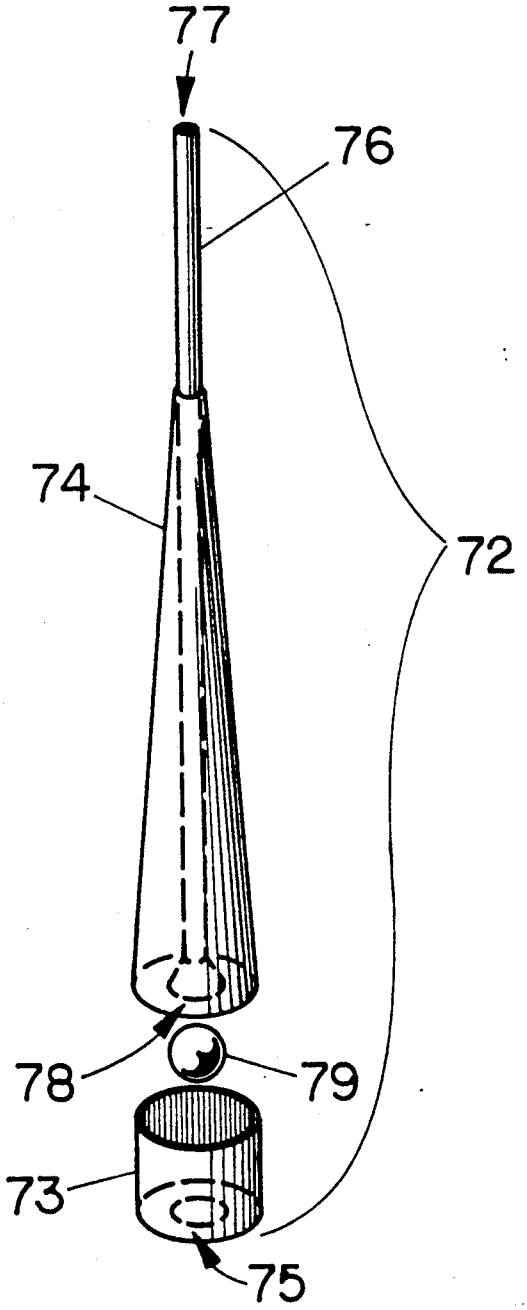
FIG. 13 is an exploded view of certain components of the device of FIG. 12.

FIGS. 12 and 13 illustrate another modified novelty squirting straw device 70 of the invention which is similar to the device 11 shown in FIG. 2. However, the device 70 includes a cylindrical member 71 (shown in FIG. 12 with a portion cut away for illustrative purposes) into which a modified stopper-type assembly 72 is mounted. The assembly 72 includes a stopper portion 73 which is sized to fit snugly into the cylindrical member 71 when the end of a resilient membrane 74 is fitted about the stopper portion 73 as illustrated in FIG. 12. The stopper portion 73 is hollow as illustrated or channelled and has an opening 75 in its bottom end. A smaller cylindrical tube 76 extends through the membrane 74 and a seal is provided about the tube 76 where it extends through the membrane 74. The tube 76 has open ends 77 and 78. A ball 79 resides within the membrane 74-stopper portion 73 assembly as illustrated. Analogous to the other embodiments described herein, the ball is sized relative to the opening 75 and the lower open end 78 of the tube 76 such that is cannot pass therethrough but rather can lodge in and seal or substantially seal the same.

In practice, the assembly 72 is inserted into the cylindrical member 71 and fits snugly therein so as to provide a fluid tight seal between the membrane-covered stopper portion 73 and the inner surfaces of the cylindrical member 71. Suitable adhesives and/or sealing compositions can also be used at these points and as well at appropriate points in the other embodiments described herein as will be clear to those skilled in this field. With the components thus in place, the device 70 operates in a similar manner to the device 11 illustrated in FIG. 2.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. Without limiting the generality of the foregoing statement, it is contemplated that other types of valves and valve arrangements than the particularly described ball type valves and arrangements are suitable for use in the invention so long as they provide the valving function necessary for the effective operation of the devices according to the invention.

I claim:

1. A squirting straw device for playing a practical joke on a drinker or on another nearby, comprising:

a cylindrical member having at least a first opening;

means for directing pressurized liquid to strike said drinker or another nearby in response to suction applied at said first opening.

2. The squirting straw device of claim 1 wherein:

said cylindrical member has first and second openings; and said means for directing pressurized liquid includes means for storing said liquid in a pressurized manner in response to said suction applied to said first opening while said second opening is immersed in said liquid, and means for projecting said pressurized liquid at said drinker or another nearby when said suction is discontinued.

3. The squirting straw device of claim 2 wherein said means for storing liquid comprises a resilient membrane.

4. The squirting straw device of claim 3 wherein said resilient membrane is positioned within said cylindrical member.

5. The squirting straw device of claim 4 wherein the periphery of said membrane is sealingly attached about the inner periphery of said cylindrical member.

6. The squirting straw device of claim 5 wherein said means for projecting liquid includes a smaller cylindrical tube having first and second openings and having an inner diameter smaller than that of said cylindrical member.

7. The squirting straw device of claim 6 wherein said cylindrical tube is positioned within said cylindrical member.

8. The squirting straw device of claim 6 wherein said cylindrical member and said smaller cylindrical tube are each formed from a suitable plastic.

9. The squirting straw device of claim 8 wherein said cylindrical member is non-transparent and has a colored pattern on its exterior surface.

10. The squirting straw device of claim 7 wherein said cylindrical tube extends through said resilient membrane leaving its said first and second openings positioned on opposite sides of said membrane, said first opening of said smaller tube occurring toward the first opening of said cylindrical member, said second opening of said smaller tube occurring toward said second opening of said cylindrical member; and said membrane also being sealingly attached about the outer periphery of said smaller cylindrical tube.

11. The squirting straw device of claim 10 wherein said means for storing liquid and said means for projecting liquid also include a ball-type valve system.

12. The squirting straw device of claim 11 wherein said ball-type valve system includes:

a generally spherical ball positioned in a space between said resilient membrane and said second opening of said cylindrical member, said ball having an outer diameter greater than the diameter of said second opening of said cylindrical member, said ball further blocking the second opening of said smaller tube when suction is applied to said first opening of said cylindrical member, and blocking the second opening of said cylindrical member after said suction is discontinued.

13. The squirting straw device of claim 12 wherein said cylindrical member, smaller tube, and ball are each constructed of a suitable plastic.

14. The squirting straw device of claim 13 wherein said cylindrical member is generally non-transparent and has an exterior surface with a colored pattern.

15. The squirting straw device of claim 1 wherein:

said cylindrical member has first and second openings; and said means for directing pressurized liquid includes means for storing said liquid in a pressurized manner prior to said suction being applied; and trigger means for releasing said pressurized liquid in response to said suction.

16. The squirting straw device of claim 15 wherein:

said pressurized liquid is released after said suction is discontinued.

17. The squirting straw device of claim 1 wherein:

said cylindrical member has first and second openings; and said means for directing pressurized liquid includes means for storing said liquid in an unpressurized manner, and syringe means for pressurizing and directing said liquid at said drinker in response to said suction.

18. The squirting straw device of claim 17 wherein said means for storing liquid includes a flexible cylindrical membrane mounted within said cylindrical member, and said syringe-type means includes a moveable circular membrane spanning the inner diameter of the cylindrical member.

* * * * *